United States Patent [19]

Schmidt et al.

[11] Patent Number: 4,844,718

[45] Date of Patent: Jul. 4, 1989

[54] METHOD OF AND APPARATUS FOR REMOVING DUST FROM COLLECTOR ELECTRODES

[75] Inventors: Hermann Schmidt, Bad Vilbel; Rainer Skroch, Frankfurt am Main, both of Fed. Rep. of Germany

[73] Assignee: Metallgesellschaft Aktiengesellschaft, Frankfurt am Main, Fed. Rep. of Germany

[21] Appl. No.: 213,639

[22] Filed: Jun. 30, 1988

[30] Foreign Application Priority Data

Jul. 4, 1987 [DE] Fed. Rep. of Germany ..... 37221930

[51] Int. Cl.[4] ..... B03C 3/74

[52] U.S. Cl. ..... 55/13; 55/112; 55/120

[58] Field of Search ..... 55/12, 13, 112, 110, 55/117, 120

[56] References Cited

U.S. PATENT DOCUMENTS 4,767,423 8/1988 Baylis ..... 55/112

FOREIGN PATENT DOCUMENTS 2829210 1/1980 Fed. Rep. of Germany ..... 55/12

36674 3/1979 Japan ..... 112/

*Primary Examiner*—Bernard Nozick

*Attorney, Agent, or Firm*—Herbert Dubno

[57] ABSTRACT

When collecting electrode walls are cleaned by rapping blows, a discharge of dust is prevented in that the aligned collecting electrode walls which are arranged one behind the other in the direction of gas flow are cleaned at the same time in all fields, the associated gas passages on opposite sides are shut off at the same time and an entraining gas stream is caused to produce in said gas passages a gas flow which is opposite to the normal direction of gas flow.

10 Claims, 2 Drawing Sheets

FROM PROGRAMMER
MAIN FLOW DIRECTION
SOLIDS COLLECTION
A
C
II
1
3
4
5
6
7
8
9
10
11
12

BACKFLOW DIRECTION
RELEASED DUST RE-ENTRAINED
A
B
D
I
t'
1
2
5
6
7
7'
7a
7b
7c
7e
9
10
11
13
20

METHOD OF AND APPARATUS FOR REMOVING DUST FROM COLLECTOR ELECTRODES

FIELD OF THE INVENTION

Our present invention relates to a method of removing dust from platelike collecting electrodes which define gas passages in a dust-collecting electrostatic precipitator for a horizontal flow of gas in at least two fields arranged one behind the other in the direction of flow of the gas, the individual collecting electrode walls being mechanically agitated in cyclic repetition while the gas flow in the two gas passages disposed on opposite sides of the collecting electrode wall that is being agitated is shut off by an inhibiting gas stream flowing in a direction that is opposite to the normal direction of gas flow.

BACKGROUND OF THE INVENTION

Published German Application No. 28 29 210 describes a process wherein, in dust-collecting electrostatic precipitators, the dust which has been deposited on the collecting electrode walls is periodically removed to maintain the full collecting capacity. For that purpose, the collecting electrode walls are vibrated in known manner, e.g. by rapping means, so that the adherent dust layers are detached and drop into the underlying dust-collecting bins. During that cleaning, part of the previously deposited dust can be reagitated by the gas stream and can be carried by the gas stream out of the dust-collecting electrostatic precipitator.

In order to minimize the so-called rapping losses, a very low velocity is usually selected for the gas stream and a plurality of fields are arranged one behind the other although this involves high capital cost.

It is known to avoid the rapping losses in that shut-off flap valves or the like are provided at the entrance or exit ends of the gas passages and in case of need can be swung from a position of rest in which they are parallel to the gas stream, to an operative position in which they are transverse to the gas stream (see U.S. Pat. No. 2,554,247). As a result, one gas passage or a plurality of gas passages can be shut off for the duration of the mechanical cleaning (agitation of the collectors) so that there will be no gas flow and no dust can be reagitated.

But such mechanical shut-off means are costly and the considerable expense in many cases is not justified by the improvement of the separating capacity which can be achieved. The main disadvantage of such shut-off means is that the bearings of the movable parts are exposed to the hot gas stream and to the dust entrained thereby so that trouble often arises during operation and high maintenance and repair costs are involved in addition to the capital cost.

In the process known from Published German Application 28 29 210, these disadvantages are overcome in that an auxiliary gas flowing opposite to the normal direction of gas flow is injected adjacent to the collecting electrode wall to be cleaned during the cleaning period. This measure has been adopted because a gas flowing at a given rate and at a given velocity can be braked by a gas flowing at a much lower rate and at a higher velocity in the opposite direction and the rate of the opposing flow which is required can be calculated by means of the momentum theorem even if details of the turbulent mixing are not known. Model calculations have shown that a gas stream flowing at a velocity of, e.g., 1.5 m/s can be braked by an opposing stream under the pressure of 20 millibars and at a volume flow rate which is 1% of the volume flow rate of the stream to be braked.

However, even this known process still requires improvement. In modern dust collectors, at least two fields are usually arranged one behind the other in the direction of gas flow. Because dust is collected at highly different rates in the different fields—in a dust collector having three fields and a total collecting capacity of 99.9% of the dust content of the raw gas, about 90% are collected in the first field, 9% in the second and 0.9% in the third—the conditions for the periodic cleaning are usually separately adjusted for each field because the collecting electrode walls must be cleaned more often in the first field than in the last field although the differences are not as large as the differences between the dust collection rates because a classification is effected in multi-field dust collectors.

Under adverse conditions, such as a low dewpoint temperature, a high dust resistance or a high gas temperature, that known mode of operation is not satisfactory because the reagitation of the previously deposited dust will inevitably raise the dust content of the pure gas above a permissible limit and said excessive dust content of the clean gas will be seen at the chimney outlet.

It has been found that relatively large quantities of dust are reagitated in such cases and that such dust cannot be recollected in one or more downstream fields although the discharge of dust from the gas passages involved is highly restricted by the inhibiting gas stream which shuts off the passages.

Particularly when peak dust loadings resulting from reagitation flow in a downstream field through a gas passage which is defined by collecting electrode walls which are about to be cleaned so that their collecting capacity is reduced, or in case of a cumulation of peak dust loadings when collecting electrode walls lying one behind the other are cleaned at the same time by coincidence, intolerably high dust concentrations may occur from time to time in the clean gas.

Problems will also arise in connection with the cleaning in the last field because dust which has been reagitated in such field cannot be collected in a succeeding field.

OBJECTS OF THE INVENTION

It is an object to eliminate the disadvantages of the process described first hereinbefore and to provide for the cleaning of collecting electrode walls an improved method in which a discharge of reagitated dust can be avoided even under the most difficult of conditions.

Another object of our invention is to provide an improved dust collector with facilitated dust removal.

SUMMARY OF THE INVENTION

These objects are attained in accordance with the invention in that aligned individual collecting electrode walls which are arranged one behind the other in the direction of flow of the gas are cleaned in all fields at the same time, the associated gas passages disposed on opposite sides are shut off in all fields and the stream of inhibiting gas is caused to produce in said gas passages a gas flow which is opposite to the normal direction of gas flow.

A difference from the previous practice resides in that the collecting electrode walls in successive fields are no longer cleaned with periodic time patterns which differ from field to field but the aligned collecting electrode walls which are arranged one behind the other are cleaned at the same time in all existing fields, the associated gas passages disposed on opposite sides of an agitated wall are shut off and an upstream gas flow is produced by which the reagitated dust is entrained out of the field in an upstream direction that is opposite to the normal direction of gas flow, and is then carried by the main gas stream to the adjacent gas passages, which are not shut off.

The collecting electrode walls which define the immediately adjacent gas passages have a medium collecting activity because one of them has been cleaned just before and the other is the next to be cleaned. Experience has shown that, in the process in accordance with the invention this medium collecting activity will be sufficient to keep the dust content of the pure gas within permissible limits even when the periodic cleaning of the collecting electrode walls results in a local reagitation of dust.

Another aspect of this invention is a dust-collecting apparatus for carrying out the above-described method and which comprises a housing defining a horizontal flow path and at least two and preferably more fields of collector electrodes spaced apart along this path in a normal direction of flow of a dust-carrying gas. Each of the fields has a plurality of horizontally spaced vertical dust-collecting electrodes each extending generally in this direction and thus having an upstream edge and a downstream edge. The electrodes of each field are aligned in this normal direction with corresponding electrodes of the other fields and flanking each electrode of each field is a pair of passages which are traversed by the dust-carrying gas in the normal direction of flow.

During the dust-collection phase of each cycle of operation, an electrostatic charge is imparted to the dust particles carried along by the dust-entraining gas, and, in accordance with principles well known from electrostatic precipitator practice, the dust is caused to deposit on the collecting electrodes. Particularly, each electrode is subjected to a cleaning phase of the cycle and the cleaning phases are stepped so that successive electrodes, e.g. sharing a passage with a previously cleaned electrode, are subjected to cleaning phases.

In each cleaning phase, along the downstream edge of all of the corresponding electrodes aligned with one another in the several fields are simultaneously subjected to a backflow from a lance extending along the respective downstream edge and directing the backflow gas into the two passages flanking the respective electrode in the obstructing direction, i.e. counter to the normal flow direction flow direction.

During this cleaning phase, moreover, the respective electrodes subjected to cleaning are impacted with respective drop hammers to dislodge the dust. The backflow gas is caused to flow at a velocity and flow rate such that, without any modification of the normal dust-carrying gas flow throughout the system as a whole, the flow within the two passages of each field which are subjected to backflow is reversed.

In practice, the bulk of the released dust falls into the collecting bins and any reentrained dust which may be carried along by the backflow gas may pass at the upstream edge of the respective plate into passages of neighboring collector plates, thereby preventing such reintrained dust from being discharged into the atmosphere.

The method, therefore, can also be considered a method of operating such an electrostatic precipitator which comprises the steps of:

(a) feeding into each of the passages flanking selected electrodes of all of the fields which are aligned with one another in the flow direction an entraining gas of a velocity and flow rate sufficient to reverse flow in the passages flanking the selected electrodes;

(b) while the entraining gas is fed into the passages flanking the selected electrodes, agitating the selected electrodes to release collected dust therefrom and discharge released collected dust from the fields;

(c) passing the entraining gas after it traverses the passages of the selected electrodes through passages flanking other electrodes of the fields; and (d) repeating steps (a) to (c) for the other electrodes of the fields.

In accordance with a preferred further feature of the process, drop hammers are used to produce the mechanical agitation. Those drop hammers are pivoted in such a manner on shafts extending at right angles to the collecting electrodes that a rotation of the shafts at the same speed will cause synchronous rapping blows to be exerted in all fields on the aligned individual collecting electrode walls which are arranged one behind the other.

Advantageously, lances which are provided with nozzles facing upstream are used to introduce the inhibiting gas stream, one of the lances extends parallel to each vertical rear boundary edge of the collecting electrode walls, and a gas stream which is opposite to the normal direction of gas flow is generated in the gas passages on opposite sides of a collecting electrode wall by a supply of inhibiting gas stream to the lance which is parallel to that collecting electrode wall and to the two adjacent lances in step with the cyclic cleaning.

The entraining gas stream is preferably maintained for a flow time which is 3 to 10 times the time which is required by the gas stream that is opposite to the normal direction of gas flow to flow through one field and the cleaning (mechanical agitation) of the collecting electrodes is effected during the first one-third of said flow time. A programmable control device is suitably used to coordinate the flow time of the drive gas stream with the sequence of the mechanical agitation and with the speed of the drop hammer shafts.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
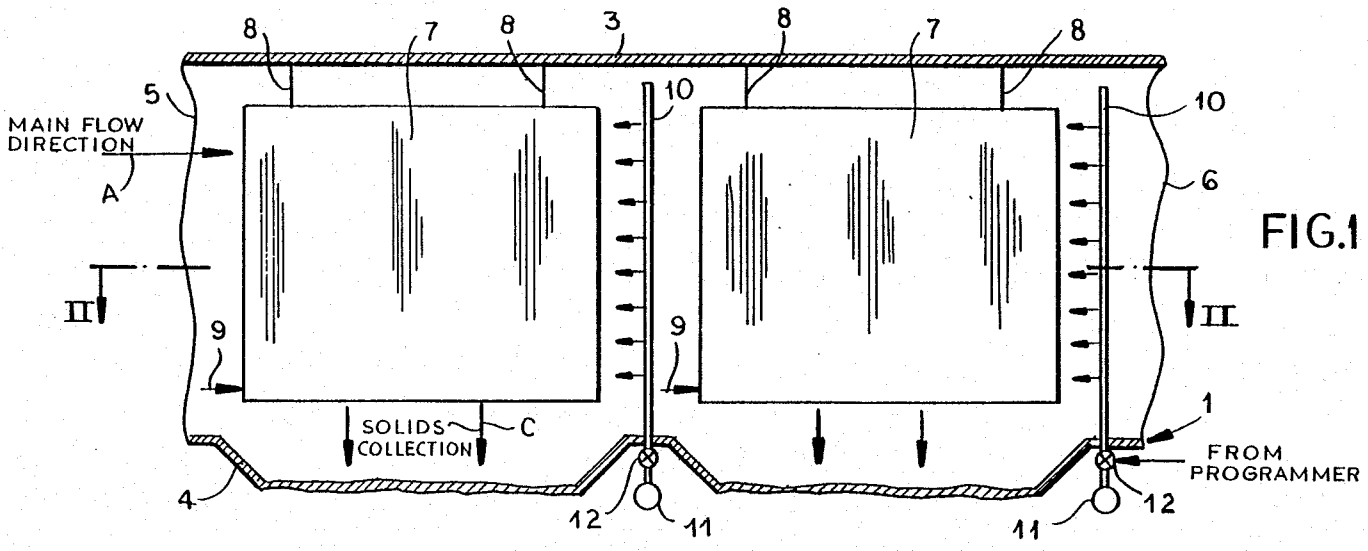
FIG. 1 is a highly simplified vertical longitudinal section view taken along line I—I of FIG. 2 and showing a dust-collecting electrostatic precipitator.

The dust-collecting electrostatic precipitator 1 has two fields and comprises a housing having side walls 2, a top wall 3 and dust-collecting bins 4 adjoining at the bottom. Gas entrance and gas exit ends are designated 5 and 6, respectively. The dust collector 1 contains collecting electrodes 7, which consist of platelike elements, which define gas passages and are suspended from carriers 8 provided at the top wall 3. The corona electrodes are disposed at the center of each gas passage and have been shown in FIG. 2 at 20 only diagrammatically.

Figure 3:
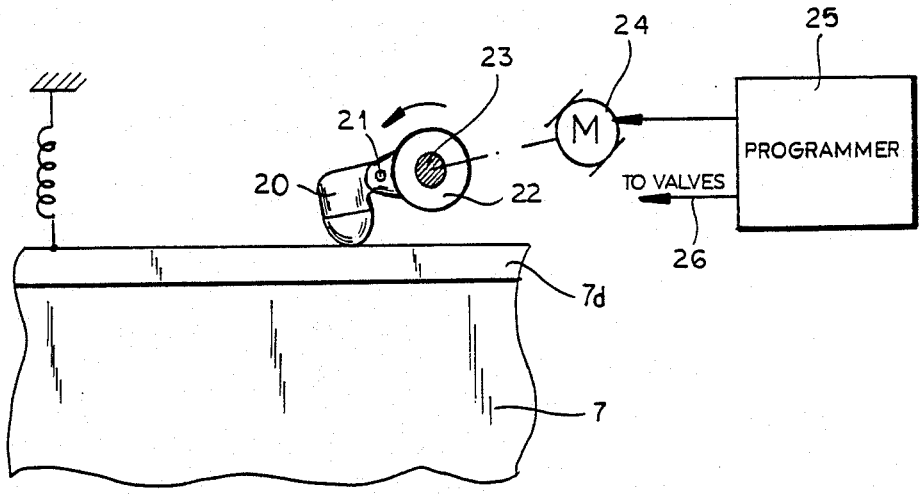
FIG. 3 is a diagram showing the relationship between the drop hammers and the plates.

The dust which has been collected on the individual collecting electrode walls can be removed by mechanical agitation, which is effected by rapping means seen in FIG. 3.

Arrows 9 indicate two aligned collecting electrode walls which are arranged one behind the other in the direction of gas flow and are simultaneously agitated by the rapping means at a given time.

Lances 10 are provided, which are parallel to each vertical rear boundary edge of the collecting electrode walls and are provided with nozzles, which face upstream and can be supplied with an entraining gas stream (dotted lines in FIG. 2) through the common lines (11 and 13) and shut-off valves (12).

In the process in accordance with the invention, those individual collecting electrode walls which are aligned and are arranged one behind the other in the direction of gas flow are cleaned at the same time in all fields (said walls are the third ones from below in FIG. 2); the associated gas passages on opposite sides are shut off at the same time and the entraining gas stream produces in said gas passages a gas flow (small arrows in FIG. 2) that is opposite to the normal direction of gas flow.

Owing to that practice, the gas stream leaving the dust collector will be prevented with a previously unachieved perfection from entraining any dust which has been reagitated during the cleaning of the collecting electrode walls so that the total collecting capacity will not be reduced by such entraining. Features of mechanical or electrical design will be adopted to ensure that the associated shut-off valves 12 will be opened at the proper times so that only those gas passages which are directly adjacent to the aligned collecting electrode walls which are arranged one behind the other and are to be cleaned will be shut off for the normal gas flow and will be supplied with an oppositely directed gas flow.

Figure 2:
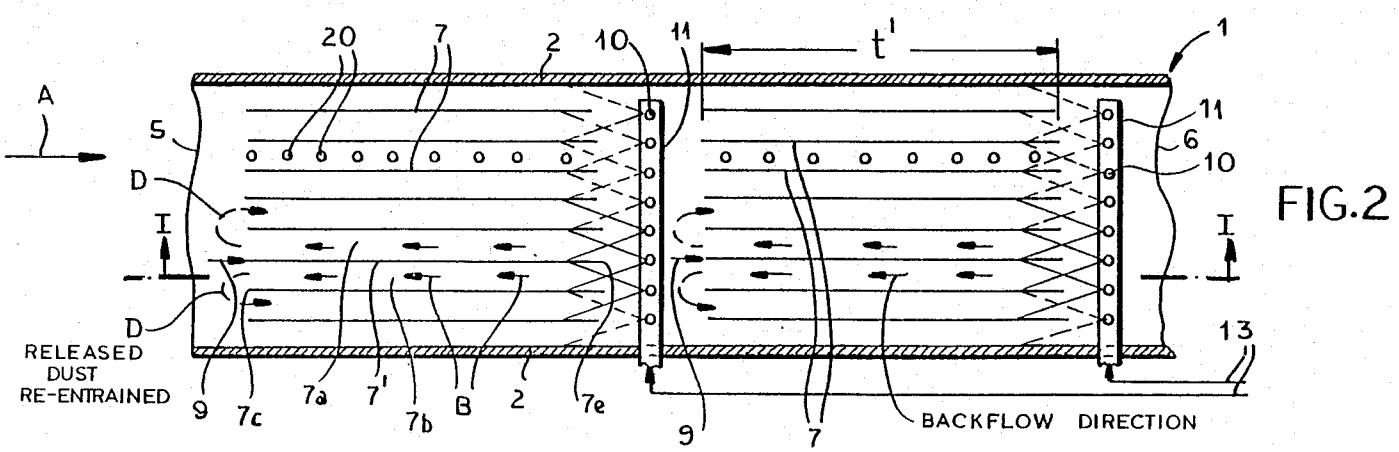
FIG. 2 is a horizontal longitudinal section view taken along line II—II of FIG. 1 and showing the same dust-collecting electrostatic precipitator.

Turning to FIG. 2, where the principles of the invention have best been illustrated, it can be seen that the main or normal flow direction of the dust-carrying gas is represented at A and that for one of the plates 7', the nozzles from the respective lance 10 drain gas into the two gas flow passages 7*a* and 7*b* with such velocity and volume flow rate that a reverse flow (arrows B) is generated in these passages whereas normal flow continues through all of the remaining passages.

When the reverse flowing gas reaches the downstream edge 7*c* of the plate 7', the gas is deflected outwardly by the oncoming main flow, since the backflow is no longer confined so as to enter passages of neighboring plates as represented by the arrows D. Meanwhile the bulk of the dust released by the wrapping action is permitted to fall as represented by the arrows C into the bins 4.

Turning to FIG. 3, it can be seen that the collector plate 7 may have bars 7*d* along the upper edges which are impacted by drop hammers 20 swingably mounted at 21 on hubs 22 carried by shafts 23 perpendicular to the planes of the plates 7 and driven by motors 24 controlled by a programmer 25 which can represent a microprogram computer, microprocessor or the like. Another output 26 from the programmer 25 is fed to the valves 12 previously mentioned. The programmer 25 thus controls the timing of each cleaning cycle as well as the cycling between plates subjected to cleaning in succession.

Figure 4:
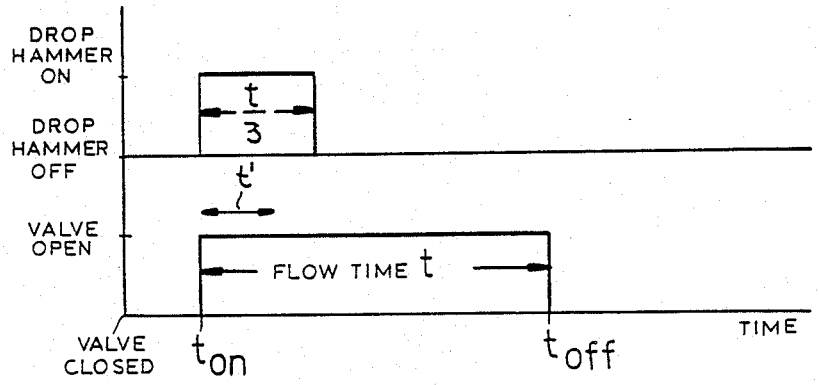
FIG. 4 is a timing diagram.

The timing diagram of FIG. 4 represents a single cleaning phase of the cycle and one such collector plate. As can be seen from FIG. 4 at $t_{on}$, the backflow is initiated and the backflow is continued through the respective lance along the upstream edge 7*e* of the respective plate for a time interval t which is 3 to 10 times the duration t' required for flow through the field and which has been represented in FIG. 4, as well.

During the first third of this interval, namely for a period of t/3, the drop hammer associated with that plate is activated by the programmer at $t_{off}$, the cleaning phase is complete and the next lance across the fields may be turned on and the cleaning phase represented in the neighboring collector plate.

We claim:

1. A method of operating an electrostatic precipitator to remove collected dust therefrom, said electrostatic precipitator comprising:

a housing oriented to be traversed by a normal horizontal flow of dust-carrying gas in a normal direction, a plurality of collecting electrode fields arranged in succession in said housing and each having a plurality of transversely spaced vertical dust-collecting electrode plates with an usptream edge and a downstream edge with respect to said normal direction, each of said dust-collecting electrode plates being flanked by a pair of passages traversed by said dust-carrying gas in said normal horizontal flow, and means for mechanically agitating said collecting electrodes to release dust collected thereon, said method comprising:

(a) feeding into each of said passages flanking single selected electrode plates of all of said fields which are aligned with one another in said flow direction an entraining gas of a velocity and flow rate sufficient to reverse flow in the passages flanking said single selected electrode plates of all of said fields;

(b) while said entraining gas is fed into said passages flanking said single selected electrode plates of all of said fields, agitating all of said single selected electrode plates which are aligned with one another to release collected dust therefrom and discharge release collected dust from said fields;

(c) passing said entraining gas after it traverses the two passages of the single selected electrode plates of each field through passages flanking other electrodes of said fields; and (d) repeating steps (a) to (c) for said other electrode plates of said fields.

2. The method defined in claim 1 wherein drop hammers are used to mechanically agitate the electrode plates, said drop hammers being pivoted in such a manner on shafts extending at right angles to the collecting electrode plates, said method comprising rotating the shafts to cause synchronous rapping blows to be exerted in all fields on the aligned individual collecting electrode plates which are arranged one behind the other in said normal direction.

3. The method defined in claim 1 wherein lances which are provided with nozzles facing upstream are used to introduce the entraining gas stream, one of said lances extends parallel to each vertical rear boundary edge of the collecting electrode plates, and a gas stream which is opposite to the normal direction of gas flow is generated in the gas passages on opposite sides of a collecting electrode plate by a supply of entraining gas to the lance which is parallel to that collecting electrode plate and to the two adjacent lances in step with cyclic cleaning of the electrode plates.

4. The method defined in claim 1 wheren the entraining gas flow is maintained for a flow time which is 3 to 10 times the time which is required for the entraining gas to flow opposite to the normal direction of gas flow through one field and the agitation of the respective collecting electrode plates is effected during the first one-third of said flow time.

5. The method defined in claim 1 wherein the flow time of the entraining gas is coordinated with the sequence of the mechanical agitation.

6. An electrostatic precipitator comprising:

a housing oriented to be traversed by a normal horizontal flow of dust-carrying gas in a normal direction;

a plurality of collecting electrode fields arranged in succession in said direction within said housing and each having a plurality of transversely spaced vertical dust-collecting electrode plates with an upstream edge and a downstream edge with respect to said normal direction, each of said dust-collecting electrode plates being flanked by a pair of passages traversed by said dust-carrying gas in said normal horizontal flow;

means for mechanically agitating said collecting electrode plates to release dust collected thereon;

means for feeding into each of said passages flanking a selected one of said electrode plates of each field and to the passages of the corresponding electrode plates of the other fields which are aligned with one another in said flwo direction, an entraining gas of a velocity and flow rate sufficient to reverse flow in the passages flanking said selected electrode plates; and programming means connected to said means for mechanically agitating said single selected electrode plates in each field wherein the agitated plates of all fields are aligned with one another to release collected dust from said fields.

7. The electrostatic precipitator defined in claim 6 wherein said means for agitating includes respective shafts extending at right angles to the collecting electrode plates and having drop hammers pivotally mounted on said shafts for exerting synchronous rapping blows on the selected corresponding electrode plates of all of said fields.

8. The electrostatic precipitator defined in claim 7 wherein the means for feeding includes a lance extending along the downstream edge of each of said electrode plates.

9. The electrostatc precipitator defined in claim 8 wherein said programming means is programmed to maintain backflow through said passages of a respective electrode plate for a period of 3 to 10 times the time.-required to traverse the respective field by the back flow.

10. The electrostatic precipitatordefined in claim 9 wherein said programming means is programmed to activate the means for mechanically agitating the selected electrode plate for the first one-third of the flow time of the backflow in said passages.

* * * * *